US005413639A

United States Patent [19]

Sato et al.

[11] Patent Number: 5,413,639

[45] Date of Patent: May 9, 1995

[54] METHOD OF MANUFACTURING LOW-CORE-LOSS GRAIN ORIENTED ELECTRICAL STEEL SHEET

[75] Inventors: Keiji Sato; Bunjiro Fukuda, both of Chiba, Japan

[73] Assignee: Kawasaki Steel Corporation, Japan

[21] Appl. No.: 6,143

[22] Filed: Jan. 19, 1993

Related U.S. Application Data

[63] Continuation of Ser. No. 908,494, Jun. 30, 1992, abandoned, which is a continuation of Ser. No. 717,814, Jun. 19, 1991, abandoned.

[30] Foreign Application Priority Data

Aug. 1, 1990 [JP] Japan ..... 2-202366
Aug. 2, 1990 [JP] Japan ..... 2-204003

[51] Int. Cl.[6] ..... C21D 8/12

[52] U.S. Cl. ..... 148/111; 148/112; 148/113; 148/120; 148/121; 148/122; 148/500

[58] Field of Search ..... 148/110, 120, 121, 122, 148/111, 112, 113, 500

[56] References Cited

U.S. PATENT DOCUMENTS 4,728,083 3/1988 Ruediger ..... 148/111
4,750,949 6/1988 Kobayashi et al. ..... 148/113

*Primary Examiner*—Richard O. Dean
*Assistant Examiner*—Sikyin Ip
*Attorney, Agent, or Firm*—Austin R. Miller

[57] ABSTRACT

A method of manufacturing a low-core-loss oriented electrical steel sheet. Thread-like grooves are formed in a cold-rolled grain oriented electrical steel sheet having a final thickness of about 0.27 mm or less in a direction within the range of about 30° from the direction perpendicular to the rolling direction. The grooves and sheet satisfy the equation $$\log d \geqq 0.6\ Ra + 0.4$$

where d is the groove depth (μm), and Ra is the mean surface roughness of the steel sheet cold-rolled to final gauge. The steel sheet is thereafter decarburization annealed and final texture annealed.

5 Claims, 2 Drawing Sheets

METHOD OF MANUFACTURING LOW-CORE-LOSS GRAIN ORIENTED ELECTRICAL STEEL SHEET

This application is a continuation of application Ser. No. 07/908,494, filed Jun. 30, 1992, abandoned, which is a continuation of application Ser. No. 07/717,814 filed Jun. 19, 1991,now abandoned.

BACKGROUND OF THE INVENTION

This invention relates to a method of manufacturing a low-core-loss grain oriented electrical steel sheet suitable for use as a material of cores of electrical apparatuses, e.g., transformers.

Grain oriented electrical steel sheets are mainly used as transformer core materials, and it is necessary for such materials to have good magnetic properties. It is particularly important to reduce the energy loss, i.e., core loss of grain oriented electrical steel sheets used as core materials.

Various attempts have been made to reduce the core loss, either by setting the orientation of crystals to the (110) [001] orientation highly uniformly, or increasing the electrical resistance of the steel sheet by increasing the Si content thereof, or reducing impurities, or reducing the sheet thickness, or using other techniques or methods.

Such conventional methods have enabled manufacture of steel sheets to be improved to some extent, that is, to achieve a core loss $W_{17/50}$ of 0.9 W/kg or less (at a magnetic flux density of 1.7 T, 50 Hz) with respect to sheet thicknesses not greater than 0.23 mm.

However, further substantial improvements in core loss cannot be expected as long as only metallurgical methods are used.

Recently, various methods of artificial domain refining have been tried as a means for achieving a substantial reduction in core loss. Some of them have been applied to industrial processes. For example, a method such the one described in Japanese Patent Publication No.57-2252 in which the surface of a steel sheet processed by final texture annealing is irradiated with a laser beam, is known.

This method can achieve a substantial reduction in core loss and, hence, manufacture of a steel sheet is possible having a thickness of 0.23mm and a core loss of $W_{17/50}$ of 0.85 W/kg or less (at a magnetic flux density of 1.7 T, 50 Hz).

This method, however, entails a drawback in that if a heat treatment such as stress relief annealing including heating at 600° C. or higher is effected after laser irradiation, the laser irradiation effect is lost. Therefore the sheet is not suitable for the cores of wound core transformers which require stress relief annealing.

Japanese Patent Publication Nos. 62-54873 and 62-53579 disclose methods of manufacturing low-core-loss grain oriented electrical steel sheets which can be used for wound core transformers. In the method disclosed in Japanese Patent Publication No. 62-54873, thread-like grooves are locally formed in a final texture annealed steel sheet by locally removing the insulating layer on the steel sheet by laser or by mechanical means and effecting etching by an acid solution on the portions from which the insulating layer has been removed, or by scribing the steel directly and mechanically with a knife or the like, and forming a phosphate tension-applying coating so as to fill the grooves. In the method disclosed in Japanese Patent Publication No. 62-53579, grooves having a depth of 5 μm or greater are formed in a final texture annealed steel sheet with a load of 90 to 220 kg/mm$^2$, and the steel sheet is thereafter heat-treated at 750° C. or higher.

These methods of forming grooves, however, are disadvantageous. In the case of Japanese Patent Publication No. 62-54873, it is difficult to remove the coating with stability because of differences in the coating thickness and the light absorption coefficient and, hence, to form grooves uniformly. In particular, where direct mechanical scribing is effected, burring occurs along the periphery of each groove, resulting in a reduction in space factor. In the case of Japanese Patent Publication No. 62-53579, it is difficult to adjust the load for obtaining grooves having a constant depth. Where grooves are formed in a final texture annealed steel sheet as in these methods, the coating is damaged by the formation of the grooves to an extent such that it is necessary for the steel sheet to be coated with the insulating material again, resulting in a reduction in space factor and an increase in manufacturing cost.

Japanese Patents Laid-Open Nos. 59-197520 and 63-42332 disclose methods arranged to solve these problems: one in which thread-like grooves are formed in a cold-rolled steel sheet having a final gauge by knife edges, laser or other means, and one which is based on photoetching or electrolytic etching using a stencil.

The method disclosed in Japanese Patent Laid-Open No. 59-197520 is free of any need for re-coating but still entails a need to remove burring formed along the periphery of each groove. In the case of the method disclosed in Japanese Patent Laid-Open No. 63-42332, there is difficulty in uniformly maintaining, for photoetching, the state of exposure to ultraviolet light through the mask and the state of etching of the exposed portion immersed in a developer with respect to the whole of the coil, and the problem of difficulty in uniformly forming grooves by electrolytic etching using a stencil because of spreading of the electrolytic solution. In particular, when the thickness of the steel sheet is small, 0.27 mm or less, there are large variations in magnetic properties, and these properties cannot always be stabilized.

SUMMARY OF THE INVENTION

In view of the above-described problems, an object of the present invention is to provide an improved manufacturing method which makes it possible to manufacture a grain oriented electrical steel sheet having stabilized magnetic properties even if the sheet thickness is small.

To achieve this object, according to the present invention, there is provided a method of manufacturing a low-core-loss grain oriented electrical steel sheet, comprising the steps of locally forming thread-like grooves having a depth which is critically related to the surface roughness of the sheet, particularly a cold-rolled grain oriented electrical steel sheet having a final thickness of 0.27 mm or less. The grooves are preferably arranged in a direction within the range of 30° from the direction perpendicular to the rolling direction; the grooving treatment is followed by processing the steel sheet by decarburization annealing; and then processing the steel sheet by final texture annealing; the groove depth is controlled to be within the relationship $$\log d \geqq 0.6\ Ra + 0.4$$

where d is the groove depth (μm), and Ra is the mean surface roughness (μm) of the steel sheet cold-rolled to final gauge.

DESCRIPTION OF THE PREFERRED EMBODIMENT

The present invention has been achieved as described below.

In general, grain oriented electrical steel sheets are manufactured by a process described below. A slab from which a grain oriented electrical steel sheet is manufactured is hot-rolled, and the hot-rolled sheet is annealed and is cold-rolled one time or two or more times with intermediate process annealing until its thickness is reduced to a final thickness. It then undergoes decarburization annealing and final texture annealing, and is, ordinarily, coated with a top coat, thereby being finished as a product.

The method of reducing the core loss comprising locally forming grooves in the grain oriented steel sheet was reexamined and we have discovered that, with respect to final sheet thicknesses equal to or less than about 0.27 mm, many steel sheets which are formed under different cold-rolling conditions and in which grooves having the same depth are formed have different core loss improvement characteristics. Even if the desired core loss value is obtained with respect to some steel sheets, the core loss improvement of other steel sheets is limited, and the average core loss value of all steel sheets in the production run may still be unsatisfactory.

Our study reached the conclusion that steel plates have different degrees of surface roughness, and that the core loss improvement of each sheet is thereby influenced. Ordinarily, the surface roughness of a steel sheet cold-rolled to final gauge largely varies according to the surface roughness of the roll, the kind and the deterioration of the rolling oil, the rolling speed, the diameter of the roll and other factors. The smallest surface roughness is about 0.1 μm and the largest surface roughness is several microns.

We have prepared five types of steel sheets cold-rolled to a thickness of 0.23 mm and having different surface roughnesses. The mean surface roughnesses of the steel sheets prepared were 0.07, 0.18, 0.35, 0.72 and 0.94 μm, and thread-like grooves having the depth of about 2 to 40 μm were locally formed in these steel sheets by printing patterns of an etching resist ink on non-etched portions, etching the steel sheet by electrolytic etching, and thereafter removing the etching resist. The width of each thread-like groove was about 150 μm, the direction in which the grooves extended was perpendicular to the rolling direction and the grooves were arranged at intervals of 4 mm.

Figure 1:
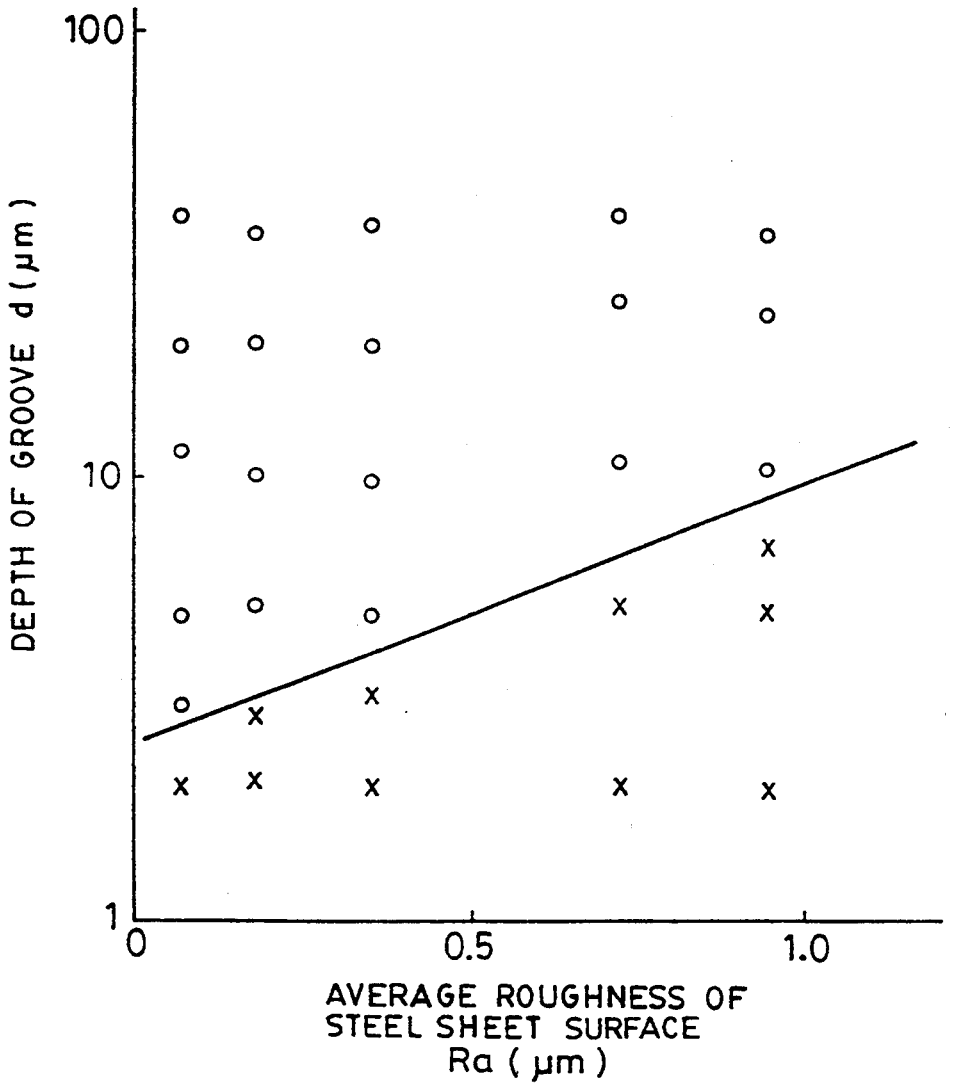
FIG. 1 is a graph showing the relationship between the mean surface roughness of a steel sheet and the depth of grooves influencing the core loss improvement.

These steel sheets were thereafter decarburization-annealed and final texture annealed to obtain product steel sheets, and the core loss $W_{17/50}$ of each of these steel sheets after stress relief annealing was measured with an Epstein tester. Steel sheets which were prepared as comparative examples and in which no grooves were formed were also annealed as described above and their core losses were measured. FIG. 1 of the drawings shows the results of this experiment, i.e., the relationship between the average surface roughness of each of the steel sheets and the groove depth. In FIG. 1, the symbols o indicate cases where the core loss $W_{17/50}$ was improved by 0.03 W/kg or more in comparison with the comparative example having no grooves, and symbols indicate cases where the improvement in core loss $W_{17/50}$ was less than 0.03 W/kg or zero.

As is apparent from FIG. 1, it was found that it is necessary to increase the depth of grooves if the surface roughness of the steel sheet is increased, and that if the groove depth is d (μm); and the average surface roughness of the steel sheet is Ra (μm), it is necessary to satisfy the equation:

$$\log d \geqq 0.6\ Ra + 0.4$$

to achieve an improvement in core loss with stability.

As mentioned above, the surface roughness of each cold-rolled steel sheet necessarily varies according to the rolling conditions and other factors. However, if grooves selected with respect to the surface roughness in accordance with the present invention are formed, the groove formation effects can be stabilized and a satisfactory core loss reducing effect can be achieved.

The thread-like grooves may be formed like dotted lines or curved lines as well as straight lines. It is most advantageous to arrange the thread-like grooves perpendicular to the rolling direction. However, the invention is effective so long as the direction of the grooves is within the range of about 30° from the direction perpendicular to the rolling direction.

In accordance with the present invention, a steel sheet cold-rolled to a final thickness by a method which is known is used. Grooves are locally formed in this steel sheet. A treatment for changing the surface roughness of the steel sheet may be effected before or after the formation of the grooves. For example, the surface of a steel sheet having a large average roughness may be smoothed by polishing or the like or, conversely, the surface of a steel sheet may be roughened by acid cleaning. It is essential to locally form grooves in the steel sheet before decarburization annealing and to provide a relationship between the groove depth and the surface roughness of the steel sheet in accordance with the range of the above equation.

However, if the grooves are excessively deep, the magnetizing current is increased to some level although the core loss is reduced. Therefore the groove depth should be about 100 μm or less or, more preferably, about 5 to 50 μm.

Some groove forming methods such as scribing which cause burring cannot be adopted since they reduce the space factor. Any groove forming method can be adopted except for those reducing the space factor, but electrolytic etching or chemical etching is preferred. The width of each groove is about 5 to 300 μm and the space between each groove is 1 mm or larger, or more preferably, about 3 to 30 mm. The desired core loss reduction effect cannot be obtained if the width is 1 mm or less.

A process of forming grooves in the steel sheet surface in accordance with the present invention will be described below in detail.

In this process, an etching resist is applied to a surface of a steel sheet cold-rolled to final gauge by printing so that thread-like non-application regions, continuous or discontinuous, extend in a direction crisscrossing the rolling direction and are not covered with the resist. They are fixed on the surface by baking, the steel sheet is etched to form continuous or discontinuous thread-like grooves in its surface, and the resist is thereafter removed.

An etching resist having an alkyd resin as a main constituent was applied, by photogravure offset printing, to a surface of a steel sheet cold-rolled to final gauge having a thickness of 0.20 mm with respect to the overall coil length so that thread-like non-application regions were left which had a width of 0.2 mm in a direction perpendicular to the rolling direction and which were arranged at intervals of 4 mm in the rolling direction. The resist was fixed by baking at 200° C. for 30 seconds. At this time, a roll worked so as to have a recessed cell density of 150 cells/inch and a cell depth of 50 μm was used as the photogravure plate, and the thickness of the resist after baking was 2 μm.

The average surface roughness of this cold-rolled steel sheet was 0.22 μm.

The steel sheet to which the etching resist was applied in this manner was etched by electrolytic etching or chemical etching so as to form thread-like grooves having a width of 0.2 mm and a depth of 20 μm, and was then immersed in an organic solvent to remove the resist. The electrolytic etching was effected in an NaCl electrolytic solution at a current density of 0.1 A/cm$^2$ for 20 seconds. The chemical etching was effected by immersing the steel sheet in an $HNO_3$ solution for 10 seconds.

After the formation of the grooves, the grooves were sampled at 20 places in the longitudinal direction of the coil and 10 places in the widthwise direction, and the width and the depth of the sampled groove portions were measured with a roughness meter.

After this operation, the steel sheet was decarburization-annealed and final texture annealed and was coated with a top coat, thereby obtaining a product sheet.

Epstein test pieces were cut out from the thus-obtained product sheet at 20 places along the longitudinal direction, subjected to stress relief annealing, and measured with respect to magnetic properties.

Table 1 shows the results of the measurement of the width and depth of the grooves, and Table 2 shows the results of the measurement of magnetic properties.

TABLE 1

| | Widthwise direction of coil (n = 10) | | | | Longitudinal direction of coil (n = 20) | | | | |
|---|---|---|---|---|---|---|---|---|---|
| | Groove width (mm) | | Groove depth (μm) | | Groove width (mm) | | Groove depth (μm) | | |
| Processing method | Mean value | Dispersion σ | Mean value | Dispersion σ | Mean value | Dispersion σ | Mean value | Dispersion σ | Note |
| Offset printing + Electrolytic etching | 0.21 | 0.015 | 19 | 0.5 | 0.20 | 0.012 | 19 | 0.6 | Example of the invention |
| Offset printing + Chemical etching | 0.20 | 0.013 | 20 | 0.6 | 0.21 | 0.014 | 19 | 0.6 | Example of the invention |
| Photoetching | 0.17 | 0.032 | 16 | 2.8 | 0.15 | 0.046 | 13 | 5.2 | Comparative example |
| Stencil + Electrolytic etching | 0.23 | 0.023 | 17 | 1.4 | 0.28 | 0.031 | 12 | 4.7 | Comparative example |

TABLE 2

| | Magnetic properties (n = 20) | | | | | | |
|---|---|---|---|---|---|---|---|
| | Core loss $W_{17/50}$ (W/kg) | | | Magnetic flux density $B_8$(T) | | | |
| Processing method | MAX | MIN | Mean | MAX | MIN | Mean | Note |
| Offset printing + Electrolytic etching | 0.73 | 0.69 | 0.71 | 1.93 | 1.92 | 1.92 | Example of the invention |
| Offset printing + Chemical etching | 0.73 | 0.70 | 0.72 | 1.93 | 1.90 | 1.91 | Example of the invention |
| Photoetching | 0.88 | 0.70 | 0.78 | 1.93 | 1.91 | 1.92 | Comparative example |
| Stencil + Electrolytic etching | 0.87 | 0.70 | 0.77 | 1.94 | 1.92 | 1.93 | Comparative example |
| Unprocessed | 0.88 | 0.83 | 0.86 | 1.94 | 1.92 | 1.93 | Comparative example |

$W_{17/50}$ represents a core loss at 1.7T, 50Hz, and $B_8$ represents a magnetic flux density at a magnetizing force of 800A/m.

Tables 1 and 2 also show the results of measurement of comparative examples with respect to a case where a cold-rolled sheet was photoetched, a case where a cold-rolled sheet was etched by electrolytic etching using a stencil and a case where no etching was effected. The photoetching was effected by a process of applying a synthetic bichromate colloid as a photo resist, irradiating the steel sheet with arc light, and immersing the steel sheet in an $HNO_3$ solution for 10 seconds. The resist was removed by immersing the steel sheet in an alkali solution and brushing the surface. In the tests using a stencil, a stencil in which holes are formed in positions corresponding to the etched portions of steel sheet was placed on the steel sheet, and a roller type cartridge containing an electrolytic solution and cathode was rotated on the stencil. The processing conditions were such that the current density was 0.1 A/cm$^2$, and the processing time was 20 seconds.

As is apparent from Tables 1 and 2, the grooves formed in the steel sheet processed in accordance with the present invention are improved in uniformity of the width and thickness in comparison with those formed by the conventional methods. Accordingly, the core loss can be determined with stability with respect to the overall coil length.

In the case of the conventional methods, the smallest core loss value may be substantially equal to that attained by the present invention, but the mean values of the core loss are greater since the variations of the groove width and depth along the longitudinal direction of the coil are large.

The space factor of the products obtained in accordance with the present invention is 97.2%, which is very advantageous and is substantially equal to that of an unprocessed sheet, which is 97.3%.

The reason for the reduction in core loss in the case of the present invention has not been clarified but it is considered that localized grooves tend to influence the core loss in the final texture annealing atmosphere, or have the effect of fractionizing the domains of the product.

The method of printing the resist in accordance with the present invention is not particularly limited. Photogravure offset printing, photogravure printing using no offset roll, lithographic offset printing, screen printing or the like may be utilized. However, photogravure offset printing is most advantageous because if it can be easily adapted to a process of continuous printing according to the coil, because it enables desired printing faces to be obtained constantly stably while the wear of the roll is limited, and because it enables the resist thickness to be controlled easily.

Next, the selection of the thickness of the resist will be described below. The inventors of the present invention formed resist films having different thicknesses and examined the influence of the thickness upon the properties of the product on the assumption that a certain thickness of resist is required when the resist is used as an etching resist.

The thickness of the resist was changed by variously changing the depth of the recessed mesh cells of a photogravure roll plate cylinder for photogravure offset printing and the pressing depth of a rubber transfer roll, and by utilizing screen printing. The test pieces were cold-rolled sheets having a final thickness of 0.20 mm on which thread-like grooves were formed by electrolytic etching after the application of the resist. The conditions of processing of patterns at the time of printing and electrolytic etching were the same as in the experiment described above.

Figure 2:
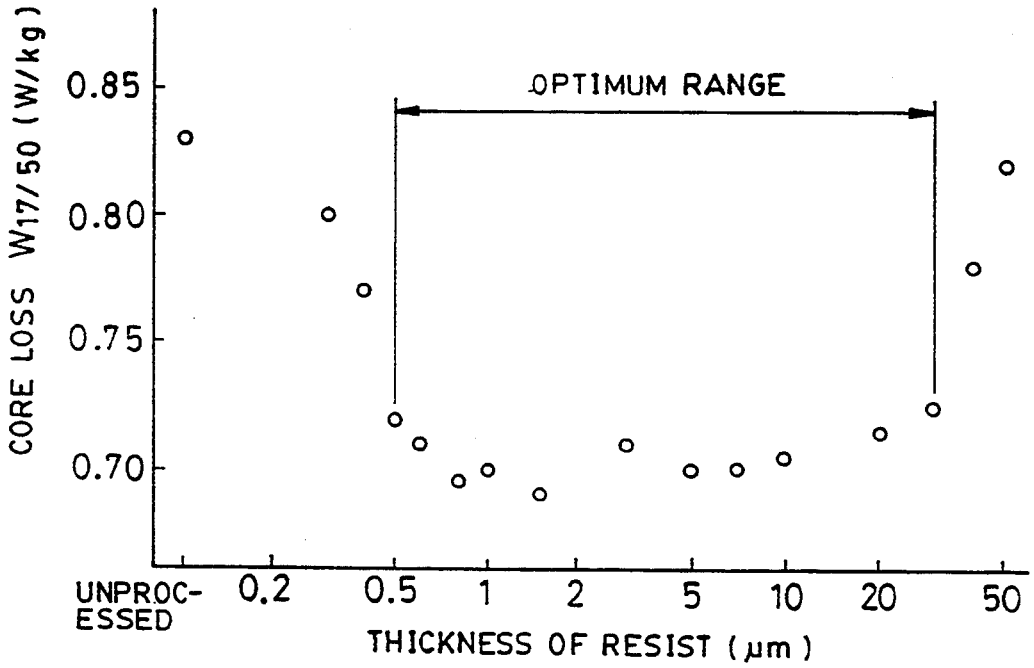
FIG. 2 is a graph of the relationship between the thickness of an etching resist and the core loss $W_{17/50}$(W/kg) of the product.

FIG. 2 of the drawings shows the relationship between the core loss $W_{17/50}$ and the thickness of the resist after final annealing.

As is apparent from FIG. 2, in a resist thickness range of 0.5 to 30 μm, the core loss is remarkably reduced in comparison with an unprocessed sheet. When the resist thickness is smaller than 0.5 μm or larger than 30 μm, the reduction in the core loss is limited.

To make clear the cause of this phenomenon, the etched steel sheets were observed and it was found that the resist itself was corroded by etching when its thickness was smaller than 0.5 μm, and that the non-application portions were partially covered with the resist so that the formation of grooves having the desired depth was obstructed.

It is therefore preferable to use a thickness of the resist within the range of about 0.5 to 30 μm in order to realize a sufficient reduction in core loss. In photogravure after printing, it is preferable to use a photogravure roll whose depth of mesh cells is 10 μm or more.

The ink used as the etching resist is, preferably, an ink containing an alkyd resin, an epoxy resin or a polyethylene resin as a main component. It is necessary to effect baking to set the resin after the application of the resist ink. For this baking, however, it is sufficient to heat the resin at a temperature such that the solvent and water contained in the ink are evaporated, e.g., 100° C. or higher.

Etching performed after printing will be described below. This etching may be electrolytic etching or chemical etching. In the case of electrolytic etching, it is preferable to etch the steel sheet in an electrolytic bath of an NaCl water solution or a KCl water solution using a current density range of 0.01 to 1 $A/cm^2$. This is because if the current density is excessively low, the desired etching effect cannot be obtained or, if the current density is excessively high, there is a risk of the resist being damaged during etching.

In the case of chemical etching, a solution of $FeCl_3$, $HNO_3$, $H_2SO_4$, $H_3PO_4$ or the like or a solution of a mixture of these compounds is preferably used.

For stabilization of the effect in terms of industrial processing, electrolytic etching is more suitable than chemical etching which tends to damage the resist.

The method of removing the resist after etching is not particularly limited. An alkali or organic solvent or the like is suitable for removing the resist.

The composition of the material processed to form a grain oriented steel sheet in accordance with the present invention is not specifically limited, and any of well known compositions can be selected. For example, a typical one of the compositions suitable for the present invention includes 0.01 to 0.08% C, 2.0 to 4.0% Si, and at least one or two of MnSe, MnS, AlN, BN provided as an inhibitor. Materials containing some of other inhibitor components such as Sb, Sn, Cu, and Bi may also be used in accordance with the present invention.

A slab the composition of which is adjusted to the above suitable composition is hot-rolled, and the hot-rolled sheet is annealed, is cold-rolled one time or two or more times with intermediate process annealing until its thickness is reduced to a final thickness, and thereafter undergoes decarburization annealing. The cold-rolled sheet is etched by the above-described method.

After being etched, the steel sheet is decarburization-annealed, is coated with an annealing separator and is finishing-annealed. After this final annealing, the annealing separator is removed and the steel sheet is covered with a top coat if necessary, thereby obtaining a product. The effects of the present invention can be exhibited irrespective of whether or not the sheet is top-coated.

The steel sheet manufactured in this manner has a stable, very small core loss value which can be maintained even after stress relieving annealing. The steel sheet can therefore be used even as a coil core material with stability. Needless to say, it may be used as the material of a laminated core which ordinarily require no stress relieving annealing.

EXAMPLE 1

A silicon steel slab containing 0.07% C, 3.25% Si, 0.07% Mn, 0.02% Se, 0.025% Al, 0.008% N and the balance substantially consisting of a composition of Fe was hot-rolled and annealed and was then cold-rolled to obtain cold-rolled sheets having final thicknesses of 0.20 and 0.23 mm.

Thread-like grooves having a width of 150 μm were formed by electrolytic etching in these cold-rolled sheets so as to be arranged at intervals of 4.5 mm in the rolling direction and to extend in a direction perpendicular to the rolling direction. The etching was effected by printing a resist ink on non-etched portions. The average surface roughness of these cold-rolled sheets was 0.25 μm and the grooves had depths of 3 and 20 μm.

After the resist ink had been removed, the steel sheets were decarburization-annealed in a humid hydrogen atmosphere and were final texture annealed at 1200° C.

Epstein test pieces were cut out from the product sheets thus obtained and were annealed at 800° C. for 3 hours for stress relieving, and the core loss of each of these test pieces was measured.

Table 3 shows the results of this measurement in comparison with other steel sheets having no grooves. Those formed in accordance with the present invention were remarkably improved in core loss properties with respect to both the two sheet thicknesses.

TABLE 3

| Sheet thickness (mm) | Groove depth (μm) | $W_{17/50}$ max (W/kg) | $W_{17/50}$ min (W/kg) | $W_{17/50}$ max–min | Note |
|---|---|---|---|---|---|
| 0.20 | 3 | 0.87 | 0.82 | 0.05 | Comparative example |
| | 20 | 0.71 | 0.69 | 0.02 | Example of the invention |
| | None | 0.88 | 0.83 | 0.05 | Example of conventional sheet |
| 0.23 | 3 | 0.95 | 0.90 | 0.05 | Comparative example |
| | 20 | 0.77 | 0.75 | 0.02 | Example of the invention |
| | None | 0.97 | 0.91 | 0.06 | Example of conventional sheet |

EXAMPLE 2

A silicon steel slab containing 0.04% C, 3.35% Si, 0.07% Mn, 0.02% Se, 0.026% Sb, and the balance substantially consisting of a composition of Fe was hot-rolled, was cold-rolled two times with intermediate process annealing at 975° C. for 2 minutes, and was cold-rolled to obtain sheets having a final thickness of 0.18 mm.

The sheets thereby obtained were polished so that the average roughness thereof was 0.08 μm, and were chemically etched with $HNO_3$. Except for the above polishing and etching, the process was the same as Example 1. However, the grooves had depth of 2, 5 and 15 μm.

After groove formation, the magnetic properties of product sheets obtained by the same processing as Example 1 were examined. Table 4 shows the results of this examination.

In this case, as well, the sheets obtained by the present invention were remarkably improved in core loss.

TABLE 4

| Groove depth (μm) | $W_{17/50}$ (W/kg) | Note |
|---|---|---|
| 2 | 0.79 | Comparative example |
| 5 | 0.67 | Example of the invention |
| 15 | 0.65 | Example of the invention |
| None | 0.80 | Example of the conventional sheet |

EXAMPLE 3

A silicon steel slab containing 0.062% C, 3.3% Si, 0.076% Mn, 0.024% Se, 0.025% Al, 0.008% N and the balance substantially consisting of a composition of Fe was hot-rolled, annealed at 1050° C. for 2 minutes, and cold-rolled to obtain a sheet having a final thickness of 0.20 mm.

From this rolled coil, five samples having average surface roughnesses Ra ranging from 0.20 to 0.25 μm were prepared and were respectively processed by the following treatments:

1) electrolytic etching after application of a resist by photogravure offset printing,
2) chemical etching after application of a resist by photogravure offset printing,
3) photoetching,
4) electrolytic etching using a polyurethane stencil; and
5) no processing.

For photogravure offset printing, a photogravure roll of 175 mesh having 40 μm depth of mesh cells was used, and an ink having an epoxy resin as a main constituent was used as a resist. The thickness of the resist after baking was 3 μm. Electrolytic etching was effected in a KCl electrolytic solution at a current density of 0.08A/cm$^2$ for 30 seconds. Chemical etching was performed by immersion in an $FeCl_3$, solution for 20 seconds. Photoetching was performed by using a synthetic bichromate colloid as a photo resist and by spraying an $FeCl_3$ solution for 20 seconds. For electrolytic etching using a polyurethane stencil, a polyurethane stencil was placed on the steel sheet, a roller type cartridge containing an NaCl electrolytic solution and a cathode was rotated on the stencil to process the steel sheet at a current density of 0.08 A/cm$^2$ for 30 seconds.

Thread-like regions etched by these processes had a width of about 0.2 mm in a direction perpendicular to the rolling direction and were arranged at intervals of 3.5 mm. In the case of the samples obtained by the treatments (1) and (2), the depths of grooves formed by etching were within the range of 20±2 μm with respect to the overall coil length. In the case of samples obtained by the treatments (3) and (4), the groove depth was dispersed from 0 to 35 μm although the processing conditions were the same as the processes (1) and (2).

The coils processed as described above were decarburization annealed and final texture annealed together with the coil unprocessed (5).

The magnetic properties of the product coils were measured by sampling in 20 places along the longitudinal direction. Table 5 shows the mean values and dispersions measured.

As is apparent from Table 5, the steel plates processed in accordance with the present invention exhibited stabilized core loss values in comparison with the conventional methods.

TABLE 5

| | Magnetic properties (n = 20) | | | | |
|---|---|---|---|---|---|
| | Core loss $W_{17/50}$ (W/kg) | | Magnetic flux density $B_8$ (T) | | |
| Processing method | Mean value | Dispersion σ | Mean value | Dispersion σ | Note |
| (1) Offset printing + Electrolytic etching | 0.69 | 0.016 | 1.92 | 0.011 | Example of the invention |
| (2) Offset printing + | 0.69 | 0.018 | 1.92 | 0.013 | Example |

TABLE 5-continued

| Processing method | Magnetic properties (n = 20) Core loss $W_{17/50}$ (W/kg) Mean value | Core loss Dispersion σ | Magnetic flux density $B_8$ (T) Mean value | Magnetic flux density Dispersion σ | Note |
|---|---|---|---|---|---|
| Chemical etching | | | | | of the invention |
| (3) Photoetching | 0.75 | 0.046 | 1.92 | 0.021 | Comparative example |
| (4) Stencil + Electrolytic etching | 0.76 | 0.042 | 1.93 | 0.009 | Comparative example |
| (5) Unprocessed | 0.86 | 0.013 | 1.94 | 0.008 | Comparative example |

EXAMPLE 4

A silicon steel slab containing 0.045% C, 3.2% Si, 0.070% Mn, 0.020% Se, 0.025% Sb, and the balance substantially consisting of a composition of Fe was hot-rolled, was cold-rolled two times with intermediate process annealing at 1000° C. for 1 minute, and was cold-rolled to obtain a sheet having a final thickness of 0.20 mm.

From this rolled coil, five samples having average surface roughnesses Ra ranging from 0.20 to 0.25 μm were prepared and were respectively processed by the following treatments:

6) electrolytic etching after application of a resist by photogravure offset printing,
7) chemical etching after application of a resist by photogravure offset printing,
8) scribing with knife edges
9) forming with laser beam; and
10) no processing.

The treatments (6) and (7) were the same as the treatments (1) and (2), and the treatments (8) and (9) were performed to form grooves having a width of 0.2 mm and a depth of 20 μm.

The coils processed as described above were decarburization annealed and final texture annealed together with the coil unprocessed (10). The magnetic properties of the product coils were thereafter measured. Table 6 shows results of this measurement.

TABLE 6

| Processing method | Magnetic properties Core loss $W_{17/50}$ (W/kg) | Magnetic flux density $B_8$ (T) | Space factor (%) | Note |
|---|---|---|---|---|
| (6) Offset printing + Electrolytic etching | 0.71 | 1.91 | 97.3 | Example of the invention |
| (7) Offset printing + Chemical etching | 0.71 | 1.91 | 97.3 | Example of the invention |
| (8) Knife edge | 0.73 | 1.90 | 95.6 | Comparative example |
| (9) Laser | 0.72 | 1.91 | 96.2 | Comparative example |
| (10) Unprocessed | 0.84 | 1.92 | 97.4 | Comparative example |

As shown in Table 6, the present invention achieved a remarkable improvement in core loss without reducing the space factor.

In accordance with the present invention, as described above, grain oriented electrical steel sheets having a small thickness of 0.27 mm or less can be manufactured at a reduced cost while ensuring suitable magnetic properties. Moreover, the properties of the grain oriented electrical steel sheets thus-obtained can be maintained during high-temperature processing such as stress relief annealing. Accordingly, the sheets can be used efficiently while effectively limiting the core loss, when applied to either stacked or wound type cores of transformers.

Although this invention has been described with reference to particular types of electrical steel sheets and to particular types and arrangements of grooves, and to particular methods of forming the grooves, it will be appreciated that the specification and the Examples and Tables contained therein are not intended to limit the scope of the patent, which is defined in the appended claims.

What is claimed is:

1. A method of manufacturing a low-core-loss grain oriented electrical steel sheet comprising the steps of applying an etching resist at a thickness of 0.5 to 30 μm to a cold-rolled grain oriented electrical steel sheet having a final thickness of about 0.27 mm or less so that surface portions of the steel sheet are left uncovered, etching the uncovered surface to form grooves extending in a direction within a range of about 30° perpendicular to the cold-rolled rolling direction, processing the steel sheet by decarburization annealing, and then processing the steel sheet by final texture annealing, depths of the grooves and roughness of the surface of the sheet satisfying an equation:

$$\log d \geqq 0.6\ Ra + 0.4$$

where d is groove depth (μm) and Ra is mean surface roughness of the cold-rolled steel sheet.

2. The method defined in claim 1 wherein the etching resist is applied so that thread-like continuous or discontinuous non-application regions are left uncovered.

3. The method defined in claim 1 wherein the etching resist is fixed to the surface of the steel sheet by baking.

4. The method defined in claim 1 wherein the etching resist is removed subsequent to etching.

5. A method of manufacturing a cold-rolled low-core-loss grain oriented electrical steel sheet, comprising: applying an etching resist to a surface of the steel sheet by printing so that thread-like non-application regions continuous or discontinuous in a direction crisscrossing the cold-rolled rolling direction are left uncovered, wherein said etching resist is fixed on the surface by baking, and has a thickness of 0.5–30 μm and wherein the steel sheet is etched to form continuous or discontinuous thread-like grooves in its surface and thereafter removing the resist, in a manner not reducing the space factor of the grooves, in a cold-rolled grain oriented electrical steel sheet having a final thickness of about 0.27 mm or less, said grooves extending in a direction within a range of about 30° from the cold-rolled direction perpendicular to the rolling direction; processing the steel sheet by decarburization annealing; and then processing the steel sheet by final texture annealing; depths of said grooves and roughness of the surface of said sheet satisfying the equation:

$$\log d \geqq 0.6\ Ra + 0.4$$

where d is groove depth (μm), and Ra is mean surface roughness of the cold-rolled steel sheet.

* * * * *

UNITED STATES PATENT AND TRADEMARK OFFICE

CERTIFICATE OF CORRECTION

PATENT NO. : 5,413,639

DATED : May 9, 1995

INVENTOR(S) : Keiji Sato and Bunjiro Fukuda

It is certified that error appears in the above-indentified patent and that said Letters Patent is hereby corrected as shown below:

In the Abstract [57], line 1, after "loss", please insert --grain--.

In Column 4, line 11, before "indicate", please insert --x--.

In Column 9, line 51, please change "depth" to --depths--.

In Column 12, line 65, please delete "cold-rolled"; and in line 66, after "the", please insert --cold-rolled--.

Signed and Sealed this

Eighteenth Day of July, 1995

Bruce Lehman

*Attest:*

BRUCE LEHMAN

*Attesting Officer*

*Commissioner of Patents and Trademarks*